United States Patent [19]

Antonas

[11] Patent Number: 4,873,507

[45] Date of Patent: Oct. 10, 1989

[54] ENCAPSULATED THERMAL PROTECTOR

[75] Inventor: Adamantios Antonas, Fairlawn, Ohio

[73] Assignee: Therm-O-Disc, Incorporated, Mansfield, Ohio

[21] Appl. No.: 108,757

[22] Filed: Oct. 15, 1987

[51] Int. Cl.[4] ..... H01C 7/10

[52] U.S. Cl. ..... 338/22 R; 338/275

[58] Field of Search ..... 338/275, 22 R, 225 D, 338/13; 219/504, 505; 29/613; 252/518-521; 427/101-103

[56] References Cited

U.S. PATENT DOCUMENTS

| | | | |
|---|---|---|---|
| 3,221,393 | 12/1965 | Sapott et al. | 338/22 X |
| 4,104,509 | 8/1978 | Van Bokestal et al. | 219/505 X |
| 4,315,237 | 2/1982 | Middleman et al. | 378/22 R |

*Primary Examiner*—C. L. Albritton

*Attorney, Agent, or Firm*—Jones, Day, Reavis & Pogue

[57] ABSTRACT

A thermal protector encapsulated in an inner layer of energy-absorbing material and an outer layer of stretchable elastomeric material. The inner and outer layers inhibit an exploding thermal protector from starting a fire.

15 Claims, 1 Drawing Sheet

ENCAPSULATED THERMAL PROTECTOR

BACKGROUND OF THE INVENTION

This application relates to the art of thermal protectors and, more particularly, to thermal protectors of the type that exhibit a sharp increase in resistivity over a particular temperature range. Devices of this type are commonly referred to as exhibiting a positive temperature coefficient of resistance, and are commonly known as PTC devices or materials.

PTC devices can explode when subjected to a voltage runaway, and expelled particles ignite when exposed to atmospheric oxygen. The glowing particles then present a fire hazard.

It would be desirable to inhibit an exploding PTC device from expelling glowing particles into the environment.

SUMMARY OF THE INVENTION

A thermal protector for electric circuits is encapsulated in a first layer of energy-absorbing material and a second layer of elastomeric material.

The first layer is preferably of a material which changes physical states when the normal operating temperature range of the thermal protector is exceeded.

The first layer traps particles and gases from an exploding PTC device, and also dampens the explosive force.

The second layer expands like a balloon within its elastic limit, absorbing further energy of the explosion, and preventing any materials or gases from being expelled.

The first and second layers may have a flame retardant additive and an antioxidant additive incorporated therein.

It is a principal object of the present invention to provide an improved thermal protector for electric circuits.

It is a further object of the invention to provide an improved manner of encapsulating a thermal protector.

It is also an object of the invention to provide a thermal protector that will not present a fire hazard in the event it explodes.

DESCRIPTION OF PREFERRED EMBODIMENTS

Figure 1:
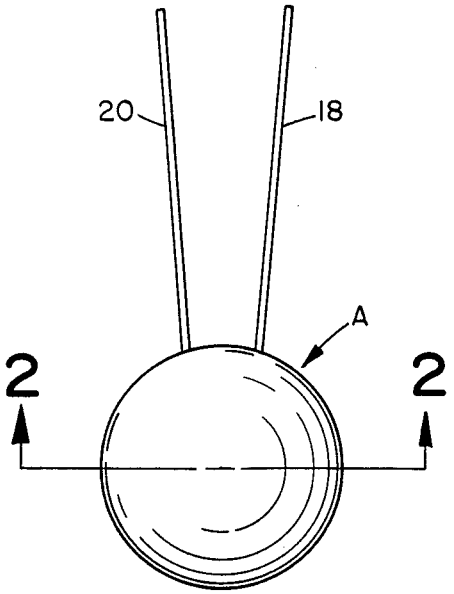
FIG. 1 is a plan view of a thermal protector constructed in accordance with the present application.
Figure 2:
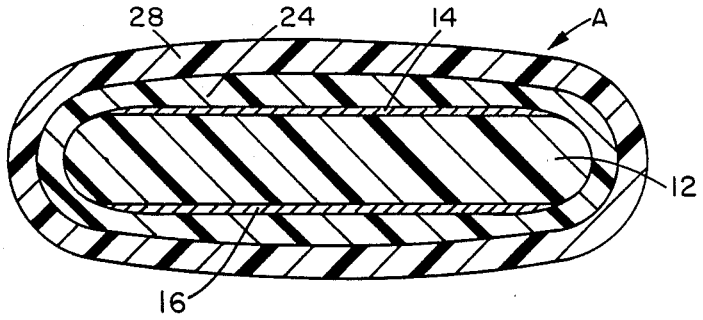
FIG. 2 is a cross-sectional elevational view taken generally on line 2—2 of FIG. 1.

Referring now to the drawing, wherein the showings are for purposes of illustrating certain preferred embodiments of the invention only, and not for purposes of limiting same, a thermal protector A includes a body 12 of a material that has a positive temperature coefficient of resistance. For purposes of this application, body 12 will be referred to as a PTC device or PTC material.

PTC material 12 can be a conductive polymer having a particulate conductive filler such as carbon black. However, the PTC material can also take other forms, including a doped ceramic such as barium titanate.

A PTC device exhibits a nonlinear change in resistance with temperature. Within a certain narrow temperature range, the electrical resistance of a PTC device jumps sharply. A PTC device may be customized to respond to either temperature conditions of the surrounding environment or to current overload conditions.

In a typical application, a PTC device is connected in series with the circuit components requiring protection. In the event of an overload condition in the system, the PTC device will reach switching temperature either by self-induced heating ($I^2R$) from the current passing through it or by sensing excessive ambient temperatures. At this point, the PTC device switches into its high resistance state, and effectively blocks the flow of current. A minimal amount of current will persist (trickle current), which holds the PTC device in its high resistance state. Once the power source has been interrupted, and the abnormal condition corrected, the PTC device will return to its rated conductive state, ready to protect the system once again.

Under extreme overload conditions, such as a voltage runaway, the PTC device may explode, and expel hot particles into the environment. The expelled hot particles, such as carbon particles, ignite upon coming into contact with atmospheric oxygen. The glowing particles present a fire hazard, because they can ignite combustible materials.

In accordance with the present application, PTC device 12 is made of rounded geometry so it has no sharp corners. PTC device 12 is shown in a round disc form with opposite flat faces, and the outer periphery is smoothly curved so it merges into the opposite flat faces along smoothly curved lines. Such a geometry minimizes weak points inherent in parts having sharp corners where carbon ejection usually occurs.

Metal foil or mesh discs 14, 16 are bonded to or embedded in the opposite faces of PTC device 12. Leads 18, 20 are connected with discs 14, 16 for connecting, thermal protector A in an electric circuit.

PTC device 12 and metal discs 14, 16 are completely encapsulated in a first layer of material 24. The material for first or inner layer 24 can take many forms including, but not limited to, tar, asphalt, putty, organic chemicals such as caffeine or animal protein, thermoplastics or intumescents.

When an intumescent material is used, it may be a combination of polyhydric compounds, dehydrating agents, blowing agents, and resin binders. When exposed to high heat, the polyhydric compound (usually a polyol) reacts with the dehydrating agent (e.g., ammonium polyphosphate) to form a carbon char. At the same time, the blowing agent, such as melamine, releases large quantities of nonflammable gases, causing the char layer to expand. The resin binders, such as vinyl copolymers, epoxies, and melamine-formaldehydes, ensure that the surface layer of the foam is sufficiently intact to keep the gases from escaping.

The intumescent material can be either water reducible or solvent reducible. Both have a carbonific material to provide the char, a phosphate to serve as a catalyst to cause the char to form, a gas producer to cause the char to foam, and a resinous material to hold it all together. The carbonific is often pentaerythritol, serving as a nonresinous source, and some resinous material, such as melamine-formaldehyde, which also lets off a gas for foam forming and provides a nonburning resinous film to contain the foam. The catalyst is commonly a diammonium phosphate. Aiding in resin formation are such materials as chlorinated rubber or chlorinated paraffin, and some formulations have antimony oxide to help evolve antimony chloride, which helps extinguish flame.

A flame retardant additive, an antioxidant, or both can be mixed in the material forming first layer 24. The flame retardant additive can be a halogenated flame retardant, such as chlorinated hydrocarbon, or can be an ammonium polyphosphate. It is also possible to include a synergist, such as antimony oxide, that evolves antimony chloride. The antioxidant can be a polymerized trimethyl dihydroquinoline.

First layer 24 is preferably of a material that absorbs energy and changes physical states when the normal operating temperature range of PTC device 12 is exceeded. First layer 24 softens and melts under the excessive temperature to absorb energy. In the event PTC device 12 explodes, the soft or melted first layer traps gases and particles, and dampens the explosive force.

A second or outer layer 28 completely encapsulates first layer 24. Second layer 28 is preferably of an elastomeric material, such as silicone rubber or latex. Second layer 28 preferably has a high: tear strength, and is capable of expanding at least 3–5 times its relaxed size without rupturing. Thus, if PTC device 12 explodes, second layer 28 will expand like a balloon without rupturing, and completely contain the explosion. However, in the unlikely event a rupture does occur, any expelled particles will be surrounded by and coated with the material of first layer 24. Second layer 28 may also have incorporated therein a flame retardant additive an antioxidant, or both.

First layer 24 can be compounded to change physical states over a temperature range of approximately 90–200° C. depending upon the design of PTC device 12

PTC material 12 can be encapsulated in epoxy or other materials before encapsulation in first and second layers 24, 28.

Although the invention has been shown and described with respect to certain preferred embodiments, it is obvious that equivalent alterations and modifications will occur to others skilled in the art upon the reading and understanding of this specification. The present invention includes all such equivalent alterations and modifications, and is limited only by the scope of the claims.

I claim:

1. A thermal protector for electric circuits, said protector being characterized by increasing sharply in resistance when a normal operating temperature is exceeded, said protector having a normal operating temperature range and being capable of exploding under extreme overload conditions, said protector being encapsulated in inner and outer layers of substantially different materials having substantially different properties, said inner layer being of an energy-absorbing material that is capable of absorbing and dissipating energy released by explosion of said protector, and said outer layer being of an elastomeric material that is capable of substantial elastic expansion without rupturing when subjected to internal force from energy released by explosion of said protector.

2. The protector of claim 1 wherein said inner layer comprises an intumescent material that intumesces when said normal operating temperature range is exceeded.

3. The protector of claim 1 wherein said inner layer changes physical states when the normal operating temperature range of said protector is exceeded.

4. The protector of claim 3 wherein said inner layer is normally solid and melts when the normal operating temperature range of said protector is exceeded.

5. The protector of claim 1 wherein said protector comprises a positive temperature coefficient device.

6. The protector of claim 1 wherein said outer layer has an interior volume and is capable of expanding to at least three times said interior volume without rupturing.

7. The protector of claim 1 wherein said protector is round and has no sharp corners.

8. The protector of claim 1 including an antioxidant dispersed in at least one of said layers.

9. A PTC device that is rounded to eliminate sharp corners and being encapsulated in first and second layers of substantially different materials having substantially different properties, said first layer being of a material which absorbs energy released by violent expansion of said device under abnormal and extreme overload conditions, and said second layer being of a material which expands substantially within its elastic limit without rupturing to contain energy released by violent expansion of said device under abnormal and extreme overload conditions.

10. The device of claim 0 wherein said first layer is solid at normal operating temperatures of said device and melts when said normal operating temperatures are exceeded.

11. The device of claim 9 wherein said first layer is of a material which absorbs energy and changes states when the normal operating temperature of said device is exceeded.

12. The device of claim 11 wherein said first layer is an intumescent material.

13. The device of claim 9 wherein said second layer comprises an elastomeric material that is capable of expanding to at least three times its volume within its elastic limit.

14. A PTC device having a normal operating temperature range and being encapsulated in intumescent material that intumesces when said normal operating temperature range is exceeded.

15. The device of claim 14 including a layer of stretchable material covering said intumescent material, said stretchable material being capable of substantial elastic expansion without rupturing.

* * * * *